US011873641B2

(12) United States Patent
Van Waardhuizen

(10) Patent No.: US 11,873,641 B2
(45) Date of Patent: Jan. 16, 2024

(54) WATERTIGHT JOINT AND METHOD OF INSTALLING A WATERTIGHT JOINT

(71) Applicant: TRELLEBORG RIDDERKERK B.V., Ridderkerk (NL)

(72) Inventor: Dirk Jan Dingeman Van Waardhuizen, Ridderkerk (NL)

(73) Assignee: TRELLEBORG RIDDERKERK B.V., Ridderkerk (NL)

( * ) Notice: Subject to any disclaimer, the term of this patent is extended or adjusted under 35 U.S.C. 154(b) by 123 days.

(21) Appl. No.: 17/603,361

(22) PCT Filed: Apr. 23, 2020

(86) PCT No.: PCT/EP2020/061273
§ 371 (c)(1),
(2) Date: Oct. 13, 2021

(87) PCT Pub. No.: WO2020/221645
PCT Pub. Date: Nov. 5, 2020

(65) Prior Publication Data

US 2022/0195719 A1 Jun. 23, 2022

(30) Foreign Application Priority Data

Apr. 30, 2019 (NL) ..... 2023031

(51) Int. Cl.
*E04B 1/68* (2006.01)

(52) U.S. Cl.
CPC ..... *E04B 1/6806* (2013.01); *E04B 1/6812* (2013.01); *E04B 1/6816* (2013.01)

(58) Field of Classification Search
CPC . E04B 1/66; E04B 1/68; E04B 1/6801; E04B 1/6806; E04B 1/6812; E04B 1/6816
See application file for complete search history.

(56) References Cited

U.S. PATENT DOCUMENTS 2,834,198 A * 5/1958 Goodman ..... E04B 1/6806 D25/123
3,099,110 A * 7/1963 Spaight ..... E04B 1/6812 277/649

(Continued)

FOREIGN PATENT DOCUMENTS

CN 2446191 Y 9/2001
CN 2446192 Y 9/2001

(Continued)

OTHER PUBLICATIONS

International Search Report and Written Opinion for PCT/EP2020/061273, dated Aug. 21, 2020, ten (10) pages.

*Primary Examiner* — James M Ference
(74) *Attorney, Agent, or Firm* — KDW Firm PLLC

(57) ABSTRACT

A waterstop joint includes a sealing strip made of an elastomer or a rubber like material, two bulged portions, each bulged portion extending along a different one of said two peripheries of the sealing strip, two fixation strips, each fixation strip extending from a different one of said two bulged portions, and extending in the same plane as the sealing strip, and a multitude of injection tubes for injecting a curing liquid, such as epoxy resin. One outer end of each of said injection tubes is mounted to, or in the vicinity of, one of the steel strips. The outer end of each of the injection tubes is mounted to, or immediately adjacent to, one of said two bulged portions.

16 Claims, 2 Drawing Sheets

(56) References Cited

U.S. PATENT DOCUMENTS 3,411,260 A * 11/1968 Dill ..... E01C 11/10 404/48
3,440,934 A * 4/1969 Dill ..... E04B 1/6807 404/74
3,461,781 A * 8/1969 Albert ..... E04B 1/6812 404/48
3,465,532 A * 9/1969 Belden ..... E02D 5/105 404/51
3,524,390 A * 8/1970 Dill ..... E04B 1/68 404/49
3,968,611 A * 7/1976 de Munck ..... E04B 1/6807 52/396.02
4,041,665 A * 8/1977 de Munck ..... E02B 3/16 404/74
4,305,680 A * 12/1981 Rauchfuss, Jr. ..... E01D 19/06 404/69
4,622,784 A * 11/1986 Black ..... E04B 1/6806 52/396.03
4,740,404 A * 4/1988 Otsugu ..... E04B 1/6807 428/44
4,884,381 A * 12/1989 Betti ..... E04B 1/6801 52/396.06
5,249,401 A * 10/1993 Schmid ..... E04B 1/6813 52/576
5,290,045 A * 3/1994 Terauchi ..... E04B 1/6816 277/921
5,737,889 A * 4/1998 Habberstad ..... E04B 1/6806 404/49
5,988,648 A * 11/1999 Schmid ..... E04B 1/6807 277/316
6,298,621 B1 * 10/2001 Lee ..... E02D 5/185 52/60
6,575,664 B1 * 6/2003 Kassel ..... F16L 21/03 277/645
6,685,196 B1 * 2/2004 Baerveldt ..... E01C 11/106 277/654
6,739,805 B2 * 5/2004 Shotton ..... E04B 1/6806 405/268
6,948,716 B2 * 9/2005 Drouin ..... E04B 1/6807 277/606
7,181,888 B1 * 2/2007 Facaros ..... E02D 31/02 52/169.5
2004/0173977 A1 * 9/2004 Drouin ..... E04B 1/6807 277/628
2006/0191224 A1 * 8/2006 Iske ..... E21D 11/383 52/415
2016/0122999 A1 * 5/2016 Curtis ..... E04B 2/84 52/395
2022/0195719 A1 * 6/2022 Van Waardhuizen ..... E04B 1/6806

FOREIGN PATENT DOCUMENTS

| | | | |
|---|---|---|---|
| CN | 2863885 | Y | 1/2007 |
| CN | 101048557 | A | 10/2007 |
| CN | 103741695 | A | 4/2014 |
| CN | 106049550 | A | 10/2016 |
| CN | 108385731 | A | 8/2018 |
| DE | 29616159 | U1 | 11/1996 |
| NL | 7612914 | A | 5/1977 |
| NL | 8700331 | A | 9/1988 |
| WO | 2018079983 | A1 | 5/2018 |

* cited by examiner

WATERTIGHT JOINT AND METHOD OF INSTALLING A WATERTIGHT JOINT

This is a national stage application filed under 35 U.S.C. § 371 of pending international application PCT/EP2020/061273, filed Apr. 23, 2020, which claims priority to Netherlands Patent Application No. NL 2023031, filed Apr. 30, 2019, the entirety of which applications are hereby incorporated by reference herein.

The invention relates to a waterstop joint comprising a sealing strip made of an elastomer or a rubber like material; two bulged portions, each bulged portion extending along a different one of said two peripheries of the sealing strip; two fixation strips, each fixation strip extending from a different one of said two bulged portions, and extending in the same plane as the sealing strip; a multitude of injection tubes for injecting a curing liquid, such as epoxy resin, wherein one outer end of each of said injection tubes is mounted to, or in the vicinity of, one of the fixation strips.

Sealing problems occur especially where concrete structures are too large to be poured as one monolithic unit. Ensuring joint water tightness is therefore of paramount concern particularly for underwater and immersed structures such as tunnels under rivers, canals, basement garages, cellars, dry docks, locks, etc.

For these applications special joint sealing systems have been developed to ensure watertight joints. Many large concrete structures are too big to be poured as one monolithic unit and therefore have a number of constructions joints.

Waterstops are produced in different types. The waterstop type depends on the water pressure and desired water tightness of the joint. In structures with low water pressure a solid rubber waterstop may be used. When water pressures are higher and no leakage is permitted, waterstops with steel strips vulcanized into the end bulbs of the rubber waterstop are used. Concrete does not adhere to rubber or PVC, but makes a good bond with the steel strip, providing the desired water tightness. The steel strip also increases the path of leakage which decreases leakage problems.

However, in practice, fissures and gravel spots are caused by shrinkage in the concrete and by errors during the pouring process. The concrete in the direct vicinity of the waterstop may therefore show seepage even though the waterstop is providing the required water tightness. In practice around 10% of all joints may have this leakage through the concrete.

The water tightness of the joint is often determined by the way a waterstop is installed. The waterstop is most vulnerable whilst installing. The internal waterstop supplied with vulcanised steel strips has holes in the strips for installation purposes. It is important to ensure that the centre of the waterstop is placed in the center of the movement/expansion joint and that the waterstop doesn't move in relation to the joint while the concrete is poured. Waterstop movement is a particular problem when there are high concrete pressures during the concrete pour. The concrete underneath the waterstop has to be vibrated and consolidated during the pour otherwise porosity, cavities and honey combing will occur. When the waterstop is mounted horizontally the ends should rise upward, in order to prevent air entrapment. The number of longitudinal ridges should also be minimised to reduce the possibility of trapping air under the waterstop. Once the waterstop has the concrete poured on one side, the other side needs to be cleaned to ensure it is free of sharp objects.

To reduce leakage, a waterstop in accordance with the preamble of claim 1 was developed by TRELLEBORG Marine and Infrastructure that allows direct injection of epoxy resin or similar into the concrete around the edges of the fixation strips of the waterstop. To that end the outer ends of epoxy resin injection tubes were mounted to the fixation strips, near the outer edges thereof, through which injection tubes epoxy resin can be pumped to the fixation strips from outside the concrete structure.

The goal of the current invention is an improved waterstop.

To that end the waterstop joint is characterized in that the outer end of each of said injection tubes is mounted to, or immediately adjacent to, one of said two bulged portions. When the curing liquid is pumped under high pressure through the injection tubes, the curing liquid will not only fill any cavities and cracks in the neighborhood, but the curing liquid will also compress the bulged portions of the waterstop against the concrete, whereby a tighter seal is achieved.

The sealing strip is preferably made of rubber, for instance styrene butadiene rubber (SBR). The fixation strips are preferably made of a metal, such as steel. The fixation strips are preferably vulcanized to the sealing strip. The injection tubes may be flexible or rigid.

The bulged portions preferably comprise a compressible portion on their outward facing sides, seen from the center of the waterstop joint, which compressible portion is made of a material that is more easily compressible than the rubber or rubber like material of the sealing strip, and the outer end of each of said injection tubes is mounted to, or immediately adjacent to, said compressible portion. Said compressible portion is preferably made of a closed-cell foam, such as polyethylene foam, polypropylene foam, polystyrene foam, elastomer foam. By the easily compressible portion the curable liquid can easily spread along the length of the bulged portion. The part of the bulged portion which is not formed by the compressible portion is preferably substantially made of the same rubber or rubber like material as the sealing strip. Said bulged portion part, which is made of rubber or a rubber like material, preferably comprises a surface facing away from the compressible portion which comprises protrusions. Said protrusions are pressed into the concrete by the curing liquid, such that a tight and strong seal is achieved.

The outer end of each of said injection tubes is preferably mounted on the fixation strip adjacent the bulged portion by means of a bracket, wherein one portion of the bracket is mounted on the fixation strip and another portion of the bracket extends away from the fixation strip near or against the bulged portion. The injection tubes are preferably removable attached to said brackets.

The fixation strips and/or the bulged portions are preferably provided with through holes near the outer end of the injection tubes, allowing the curing liquid to flow from the outer end of the injection tubes to the other side of the fixation strips. Alternatively, each injection tube is preferably accompanied by a mirrored injection tube on the other side of the fixation strip.

The waterstop joint preferably comprises a central bulged portion which is arranged to form a compressible buffer between two adjacent concrete elements in which the waterstop joint is to be mounted. Said central bulged portion is preferably made of a closed-cell foam, such as polyethylene foam, polypropylene foam, polystyrene foam, neoprene foam.

The invention also relates to a method of installing a waterstop joint in a concrete construction comprising two adjacent concrete elements, wherein during casting of the concrete one of the two fixation strips is cast in a first one of said two concrete elements and the other one of the two fixation strips is cast in the other one of said two concrete elements, and wherein after curing of the concrete a curing liquid, such as epoxy resin, is pumped under high pressure into the injection tubes. The curing liquid is preferably pumped into the injection tubes under a pressure of at least 5 bar, preferably at least 10 bar, more preferably at least 15 bar.

The invention will now be exemplified by means of a preferred embodiment, with reference to the drawings, in which.

Figure 1:
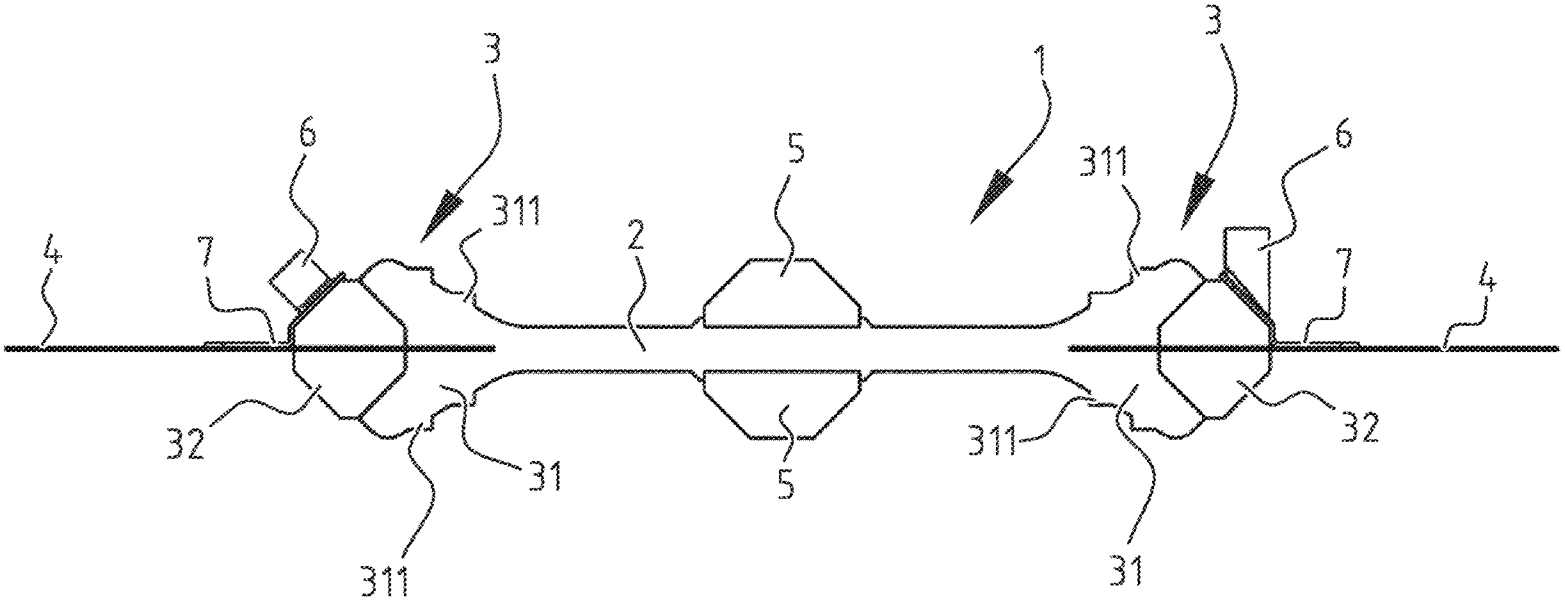
FIG. 1 is a perspective view of a waterstop joint in accordance with the invention.
Figure 2:
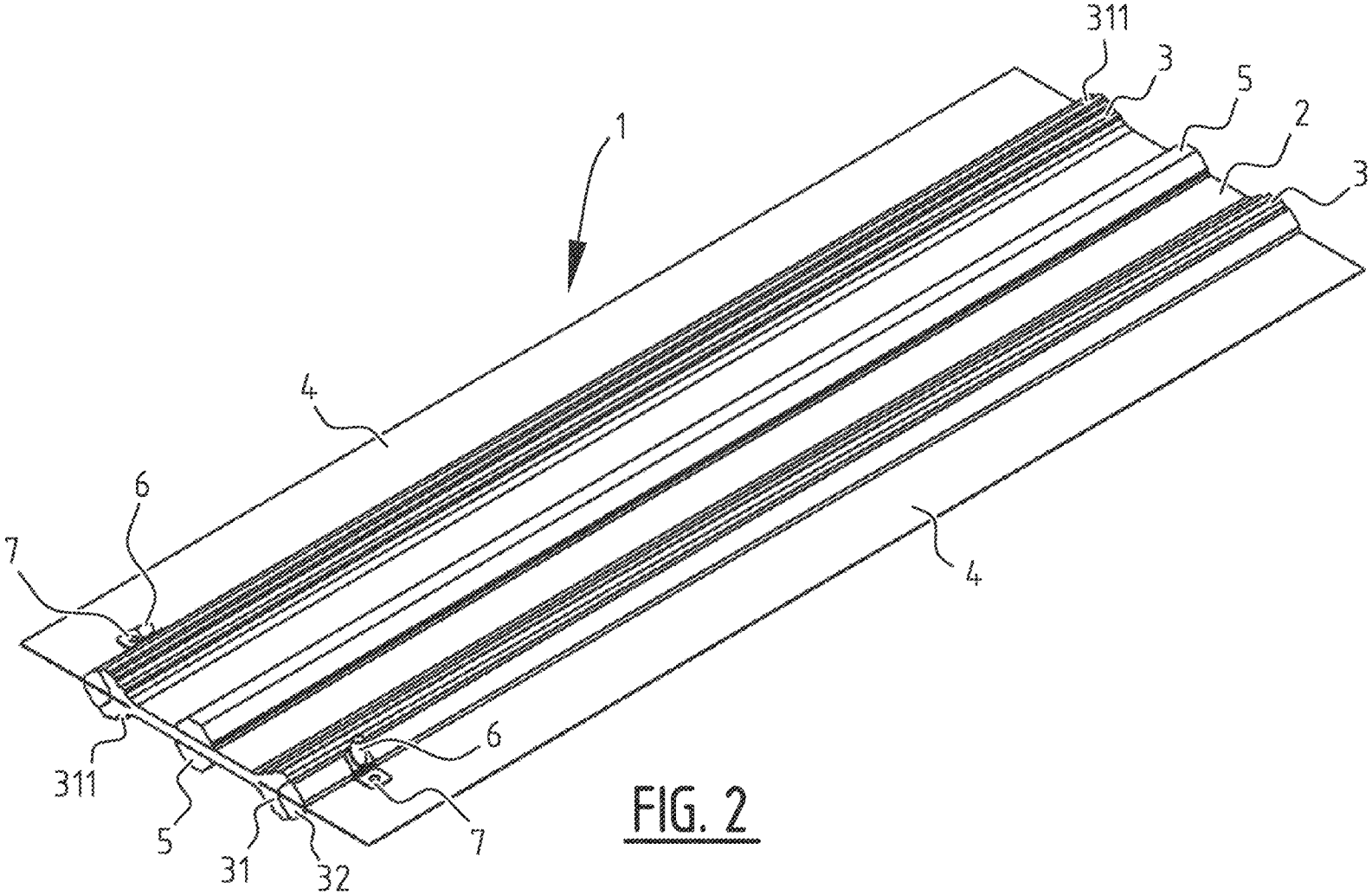
FIG. 2 is a cross sectional view of the waterstop joint of FIG. 1.

According to the figures, a waterstop joint 1 for sealing a gap between two adjacent concrete elements comprises a sealing strip 2 made of styrene butadiene rubber (SBR). Along the outer edges of the sealing strip 2 longitudinal bulged portions 3 are formed. The bulged portions 3 comprise a longitudinal rubber portion 31 which is integral with the sealing strip 2, and a longitudinal compressible portion 32 which is made of a closed-cell foam. The rubber portion 31 is provided with longitudinal protrusions 311. Steel fixation strips 4 extend into, and are vulcanized to, the rubber portions 31 of the bulged portions 3.

The waterstop joint 1 may furthermore comprise one or more compressible central bulged portions 5, which form a compressible buffer between the two adjacent concrete elements. The central bulged portions 5 may for instance be made of the same rubber as the sealing strip 2 or from a closed-cell foam like the compressible portions 32.

According to the invention epoxy resin injection tubes 6 or injection tube connectors 6 are mounted to the steel fixation strips 4 by means of brackets 7, for instance by means of welding. The brackets 7 are shaped such that they can hold the outer end of the tubes 6, or the tube connectors 6 to which the injection tubes can be attached, in such manner that the opening of the injection tubes 6 directly face the compressible portion 32. The injection tubes 6 or tube connectors 6 may extend perpendicular to the steel fixation strips 4, as shown on the right side of the figures, or be extended at an angle of for instance 45 degrees, as shown at the left side of the figures.

In order to seal the gap between two mutually adjacent concrete elements, the left side of the sealing strip 2 with its bulged portion 3, metal fixation strip 4 and injection tubes 6 is cast in one of the concrete elements, and the right side of the sealing strip 2 with its bulged portion 3, metal fixation strip 4 and injection tubes 6 is cast in the other one of the concrete elements, while the central bulged portions 5 extend between the two elements.

After the concrete is cured, epoxy resin is pumped into the injection tubes 6 at a pressure between 5 and 20 bar. The epoxy resin will compress the compressible portions 32 such that the epoxy resin is distributed along the length of the bulged portion 3, and will fill cracks and cavities in the concrete, as well as press against the rubber portion 31 with the protrusions 311, which will thereby be pressed firmly into the corresponding recesses in the cured concrete.

The invention has thus been described by means of preferred embodiments. It is to be understood, however, that this disclosure is merely illustrative. Various details of the structure and function were presented, but changes made therein, to the full extent extended by the general meaning of the terms in which the appended claims are expressed, are understood to be within the principle of the present invention. The description and drawings shall be used to interpret the claims. The claims should not be interpreted as meaning that the extent of the protection sought is to be understood as that defined by the strict, literal meaning of the wording used in the claims, the description and drawings being employed only for the purpose of resolving an ambiguity found in the claims. For the purpose of determining the extent of protection sought by the claims, due account shall be taken of any element which is equivalent to an element specified therein. An element is to be considered equivalent to an element specified in the claims at least if said element performs substantially the same function in substantially the same way to yield substantially the same result as the element specified in the claims.

The invention claimed is:

1. A waterstop joint comprising:

a sealing strip made of an elastomer;

two bulged portions, each of the two bulged portions extending along a different one of two peripheries of the sealing strip;

two fixation strips, each of the two fixation strips extending from a different one of said two bulged portions, and extending in a same plane as the sealing strip;

a multitude of injection tubes for injecting a curing liquid, such as epoxy resin, wherein one outer end of each of said injection tubes is mounted to, or is adjacent to, one of the two fixation strips;

wherein the outer end of each of said injection tubes is mounted to, or immediately adjacent to, one of said two bulged portions; and wherein the two bulged portions comprise a compressible portion on outward facing sides of the two bulged portions, as viewed from a center of the waterstop joint, the compressible portion is made of a material that is more easily compressible than the elastomer of the sealing strip, and the outer end of each of said injection tubes is mounted to, or immediately adjacent to, said compressible portion.

2. The waterstop joint of claim 1, wherein the sealing strip is made of rubber.

3. The waterstop joint of claim 1, wherein the two fixation strips are made of a metal.

4. The waterstop joint of claim 3, wherein the sealing strip is made of rubber, and wherein the two fixation strips are vulcanized to the sealing strip.

5. The waterstop joint of claim 1, wherein the injection tubes are flexible or rigid.

6. The waterstop joint of claim 1, wherein said compressible portion is made of a closed-cell foam.

7. The waterstop joint of claim 1, wherein a part of the two bulged portions which is not formed by the compressible portion is substantially made of the elastomer.

8. The waterstop joint of claim 7, wherein said bulged portion part, which is made of the elastomer comprises a surface that faces away from the compressible portion and comprises protrusions.

9. The waterstop joint of claim 1, wherein the outer end of each of said injection tubes is mounted on a respective one of the two fixation strips adjacent a respective one of the two bulged portions by a bracket, wherein one portion of the bracket is mounted on a respective one of the two fixation strips and another portion of the bracket extends away from the respective fixation strip near or against a respective one of the two bulged portions.

10. The waterstop joint of claim 9, wherein the injection tubes are removably attached to said brackets.

11. The waterstop joint of claim 1, wherein the two fixation strips and/or the two bulged portions are provided with through holes near the outer end of the injection tubes to allow the curing liquid to flow from the outer end of the injection tubes to the other side of the two fixation strips.

12. The waterstop joint of claim 1, wherein each of the injection tubes is accompanied by a mirrored injection tube on a different side of a respective one of the two fixation strips.

13. The waterstop joint of claim 1, wherein the waterstop joint comprises a central bulged portion which is arranged to form a compressible buffer between two adjacent concrete elements in which the waterstop joint is to be mounted.

14. The waterstop joint of claim 1, wherein said central bulged portion is made of a closed-cell foam.

15. A method of installing the waterstop joint in accordance with claim 1 in a concrete construction comprising two adjacent concrete elements, wherein, during casting of the concrete:

one of the two fixation strips is cast in a first one of said two concrete elements; and a second one of the two fixation strips is cast in a second one of said two concrete elements, and wherein, after curing of the concrete, a curing liquid is pumped under high pressure into the injection tubes.

16. The method of claim 15, wherein the curing liquid is pumped into the injection tubes under a pressure of at least 5 bar.

* * * * *